US009889364B1

(12) United States Patent
Toupin et al.

(10) Patent No.: US 9,889,364 B1
(45) Date of Patent: Feb. 13, 2018

(54) GOLF BALL LANDING SIMULATOR

(71) Applicant: Acushnet Company, Fairhaven, MA (US)

(72) Inventors: Michael J. Toupin, Fall River, MA (US); William Souza, Fall River, MA (US); Glenn Grenier, North Dartmouth, MA (US); Leonidas Amarant, Middletown, RI (US); Charles Hightower, Hyde Park, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/405,253

(22) Filed: Jan. 12, 2017

(51) Int. Cl.
*F41B 4/00* (2006.01)
*A63B 69/40* (2006.01)
*A63B 102/32* (2015.01)

(52) U.S. Cl.
CPC ..... *A63B 69/406* (2013.01); *A63B 2069/402* (2013.01); *A63B 2102/32* (2015.10); *A63B 2220/20* (2013.01); *A63B 2220/30* (2013.01); *A63B 2220/35* (2013.01)

(58) Field of Classification Search
CPC ..... A63B 69/406
See application file for complete search history.

(56) References Cited

U.S. PATENT DOCUMENTS

| | | | | |
|---|---|---|---|---|
| 5,125,653 | A * | 6/1992 | Kovacs | A63B 69/406 124/78 |
| 5,464,208 | A * | 11/1995 | Pierce | A63B 69/406 124/78 |
| 8,287,404 | B2 * | 10/2012 | Cucjen | A63B 69/406 124/77 |
| 8,485,174 | B2 | 7/2013 | Bissonnette et al. | |
| 8,622,845 | B2 | 1/2014 | Bissonnette et al. | |
| 2005/0272516 | A1 | 12/2005 | Gobush | |
| 2016/0151680 | A1 | 6/2016 | Furze et al. | |
| 2016/0151681 | A1 | 6/2016 | Daprato et al. | |

* cited by examiner

*Primary Examiner* — John Ricci

(57) ABSTRACT

The present invention generally relates to portable golf ball launching device for analyzing golf balls for short game performance attributes. The preferred golf ball launcher is able to shoot a golf ball at the ground at preselected speed, spin rate and angle.

9 Claims, 2 Drawing Sheets

GOLF BALL LANDING SIMULATOR

BACKGROUND OF THE INVENTION

Field of the Invention

The present invention relates generally a short game simulation system comprised of a portable golf ball launching device that is able to launch golf balls at preselected angles, speeds and spin rates to simulate the landing of a golf ball.

Brief Review of the Related Art

Co-pending U.S. application Ser. Nos. 14/557,688 and 14/816,116 disclose a hitting robot that is particularly useful in analyzing short game shots. As set forth in those applications, the golf game is comprised of many facets: driving, fairway metal shots, iron shots and putting. However, one of the most important facets to scoring well is the short game, those wedge shots that are about 125 yards and shorter. The short game also includes very short shots from bunkers, rough, hard pan lies and soft fairways. The short game, thus, comprises many different types of shots from many different conditions and testing products to confirm that they enable a player to have the best opportunities for a good short game is very difficult.

Obtaining reliable short game shot data is extremely difficult and then analyzing the effects of the shots is even more difficult. Thus, the hitting robots disclosed in the above-identified applications were created to obtain reliable ball-to-ball and club-to-club short game data. The data obtained is generally the launch conditions under substantially similar circumstances so that comparisons can be made.

SUMMARY OF THE INVENTION

The present invention generally relates to a portable golf ball launching device for analyzing short game golf ball performance. The device comprises a frame, a ball launcher rotatably coupled to the frame for launching balls at preselected angles, speeds and spin rates, and a control system coupled to the ball launcher for varying the speed and spin rate of the balls launched from the ball launcher. Preferably, the ball launcher is mounted to rotate about an axis at angles between +90 degrees to −90 degrees from the horizontal plane. More preferably, the ball launcher is designed to be rotated such that it launches balls between −20 degrees and −70 degrees to the horizontal plane, and most preferably between about −30 degrees and −60 degrees to the horizontal plane, to simulate golf balls landing on a green after being struck with a short iron.

The portable ball launcher is able to eject balls at a predetermined target and at predetermined conditions such that data can be generated and analyzed. In particular, the ball-to-ball and club-to-club data can be evaluated for things such as final roll out distance on short shots. For example, the roll out distance for 50 yard wedge shots and 100 yard wedge shots can be compared for different balls to determine the effects of constructions and materials used to make the balls.

Preferably, the portable golf ball launching device has a ball launcher comprised of an upper wheel and a lower wheel that the control system adjusts the speeds of independently to adjust the speed and spin rate of the balls being ejected from the ball launcher. More preferably, the portable ball launching device further comprises a launch monitor for measuring the speed and spin rate of the golf balls after they are launched from the ball launcher. The launch monitor can be rotatably coupled to the frame so that the angle of the launch monitor can be adjusted and can be slidably coupled to the frame such that the location of the launch monitor relative to the ball launcher can be adjusted. Most preferably, the ball launcher and the launch monitor are rotatable about a common axis.

In a preferred embodiment, the portable golf ball launching device is further comprising a laser distance finder for measuring distances to an impact location of the launched golf ball and a final roll out location of the launched golf ball. Data from the launch monitor and the laser distance finder are preferably stored on a computer for further calculations and comparisons.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Using golf ball hitting robots to evaluate golf balls and golf clubs is not new. Robots are particularly useful in that they can apply a very repeatable swing so that different golf balls or clubs can be compared. In order to collect data, launch monitors such as that disclosed in U.S. Publication No. 2005/0272516 can be used to measure ball performance characteristics which enable the evaluation of variations associated with club, ball and robot performance. Hitting robots had been designed to hit drivers and other clubs and their primary use was to evaluate club and ball performance for longer shots. U.S. application Ser. Nos. 14/557,688 and 14/816,116, however, are directed to robots specifically designed to simulate the short game shots, hitting wedges of 48 degrees or more. These hitting robots generally involve hitting down on the ball and pinching the ball between the club and the ground. A launch monitor can then be used to capture the launch conditions for further analysis and evaluation.

Similarly, golf ball launchers have been designed to more accurately launch balls so that aerodynamic characteristics of golf balls can be analyzed. For Example, U.S. Pat. No. 8,485,174 discloses a ball launcher that accurately controls ball launch conditions, including speed, spin rate and launch angle. However, like the hitting robots, the ball launchers have been primarily designed to simulate long shots.

Figure 1:
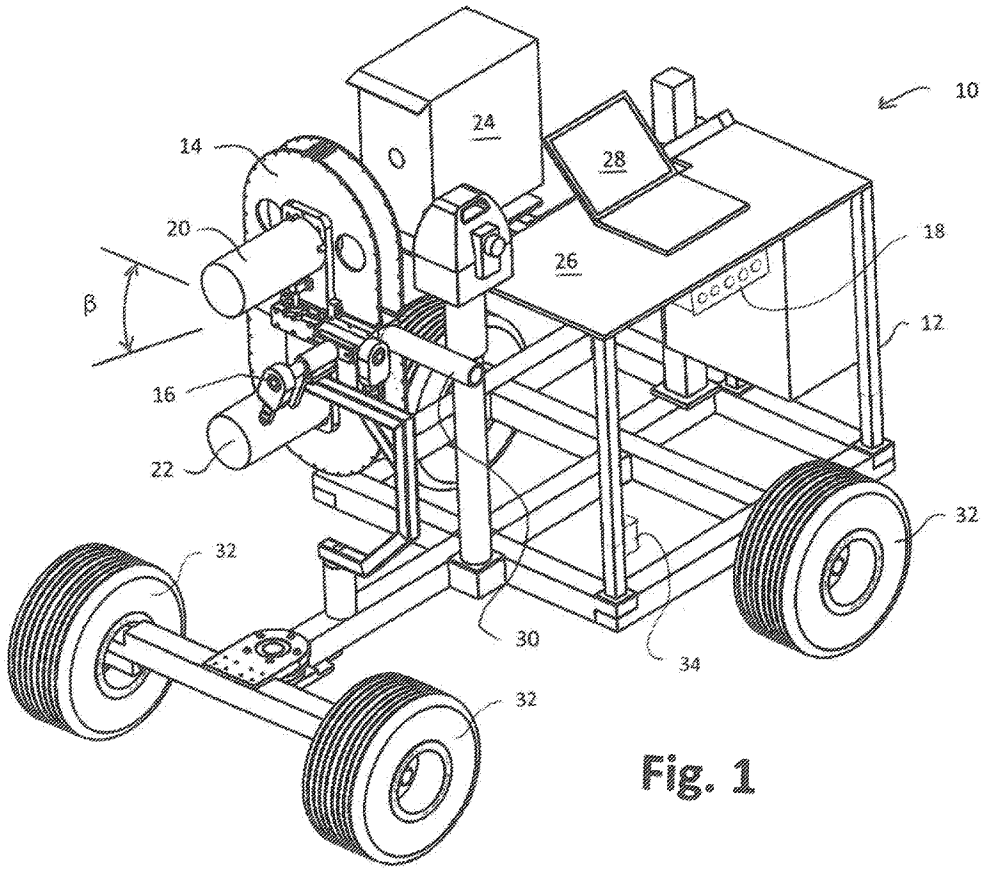
FIG. 1 is a front, right side perspective view of a portable golf ball launching device according to the present invention.
Figure 2:
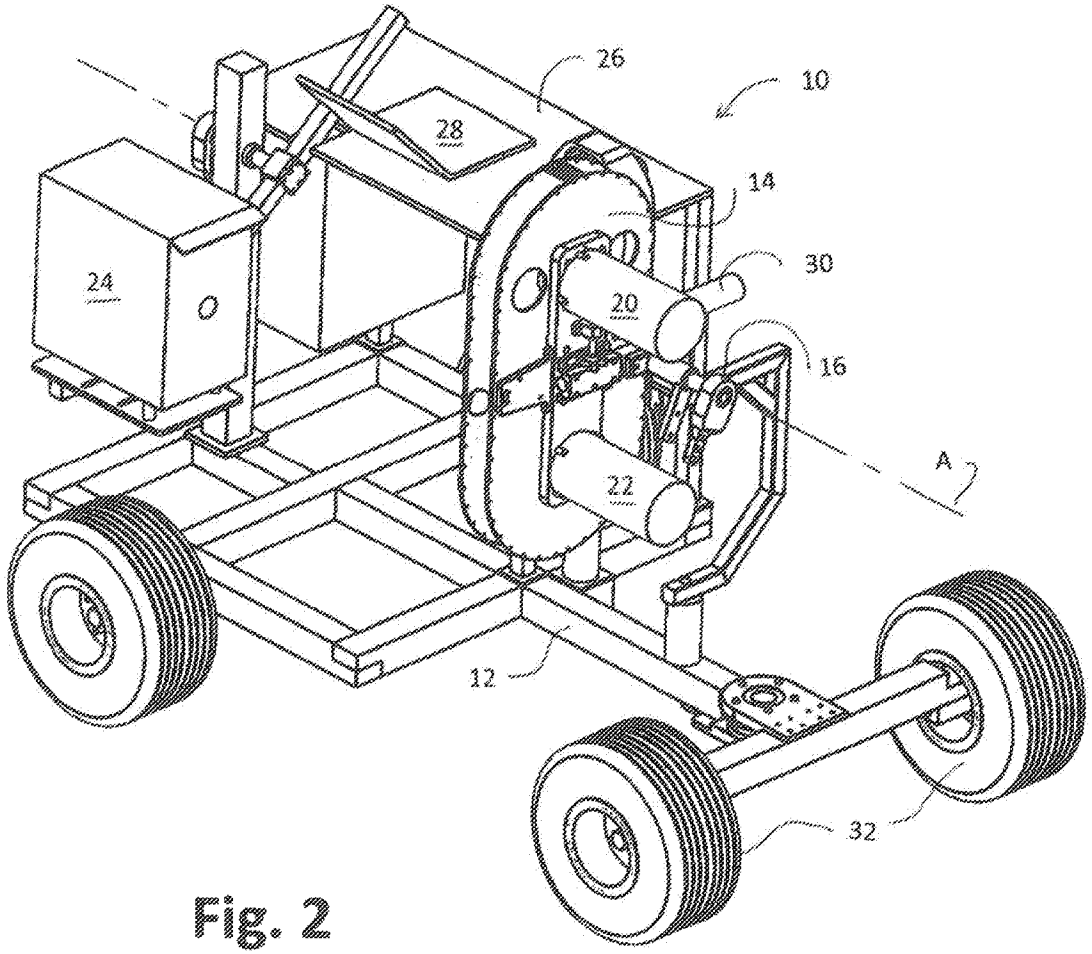
FIG. 2 is a front, left side perspective view of a portable golf ball launching device according to the present invention.

Referring to FIGS. 1 and 2, the present invention generally relates a portable golf ball launching device 10 for analyzing short game golf ball performance by being able to launch balls directly into the ground at the decent angle, speed and spin rate at the end of a short shot. The device comprises a frame 12 that can be readily moved, a ball launcher 14 rotatably coupled to the frame 12 for launching balls at preselected angles, speeds and spin rates, and a control system 18 coupled to the ball launcher 14 for controlling the launch of the ball and varying the speed and spin rate of the balls launched from the ball launcher 14. The ball launcher 14 is preferably mounted to the frame 12 about 1 to 5 feet above the ground level and is able to eject balls at a predetermined target on the ground at predetermined conditions such that data can be generated and analyzed. In particular, ball-to-ball and club-to-club data can be evaluated for things such as final roll out distance on short shots. For example, the roll out distance for 50 yard wedge shots and 100 yard wedge shots can be compared for different types of balls to determine the effects of construction and material used to make the balls.

More particularly, the ball launcher 14 is coupled to the frame 12 at rotatable joint 16 such that the ball launcher 14 can be rotated about the axis A. While the ball launcher 14 can be rotated between +90 degrees and −90 degrees from the horizontal plane, the primary purpose is to be able to rotate the ball launcher 14 to a predetermined decent launch angle β of between −20 degrees and −70 degrees to the horizontal plane, and most preferably between about −30 degrees and −60 degrees to the horizontal plane, to simulate golf balls landing on a green after being struck with a short iron. Preferably, the ball launcher 14 can be rotated in increments of 1 degree. The ball launcher 14 can be manually rotated to the predetermined launch angle β or can be coupled to the frame 12 via an electric motor that can be operated remotely to maneuver the ball launcher 14 to the predetermined launch angle β.

Preferably, the portable golf ball launching device has a ball launcher 14 comprised of an upper wheel run by an upper electric motor 20 and a lower wheel run by a lower electric motor 22. The control system 18 is preferably coupled to the right side of the frame 12 and can be used to adjust the speeds of the wheels independently to adjust the speed and spin rate of the balls being ejected from the ball launcher 14. The wheels are controlled by a Variable Frequency Drive (VFD). Each of the electric motors 20 and 22 are controlled by independent VFD controls on the control system 18. Preferably, the electric motors are controlled using 10 turn potentiometers that can be graduated from 0 to 10 in increments of 0.1 and can be locked to maintain the desired setting. The speed of the wheels is preferably measured using an optical sensor and tachometer located inside the ball launcher 14. An upper wheel and lower wheel tachometer digital display is included in the control system 18 or at a location that the operator can view is while the ball launcher is in operation. The VFD can also include a braking resistor to absorb energy while the wheels are slowing down after use.

The electric motors 20 and 22 can be powered via a ground fault circuit interrupter 34 for electrical safety. In another embodiment, the ball launcher having two upper wheels and two lower wheels as set forth in detail in U.S. Pat. No. 8,485,174, which discusses how launch monitors work and are controlled and is therefore incorporated by reference in its entirety, can also be used.

In order to measure and confirm the launch conditions from the ball launcher 14 a launch monitor 24 is coupled to the frame 12. More preferably, the portable ball launching device 10 includes a launch monitor 24 for measuring the speed and spin rate of the golf balls immediately after they are launched from the ball launcher 14. The launch monitor 24 is preferably rotatably coupled to the frame 12 on a pivot joint similar to the one used for the ball launcher 14 so that the angle of the launch monitor 24 can be adjusted to match the ball launch angle β. Also, the launch monitor 24 can be slidably coupled to the frame such that the location of the launch monitor 24 relative to the ball launcher 14 can be adjusted. Most preferably, the ball launcher 14 and the launch monitor 24 are rotatable about the same axis A. A launch monitor 24 such as that disclosed in U.S. Pat. No. 8,622,845, which is incorporated in its entirety herein, is preferably used. Thus, different golf balls having different marking patterns can be easily distinguished by the launch monitor, as set forth in the '845 patent, for evaluation purposes.

In a preferred embodiment, the portable golf ball launching device 10 is further comprising a laser distance finder that is preferably mounted on the table 26, for measuring distances to an impact location of the launched golf ball and a final roll out location of the launched golf ball. The preferred laser distance finder is a Leica Disto S910, but other equivalent devices can be used. The portable golf ball launching device is preferably equipped with a USB charging station built into the AC power receptacle so that the laser system can be easily recharged. Data from the launch monitor 24 and the laser distance finder are preferably transferred onto a computer 28 for further calculations and analysis. The data can be transferred via a wireless connection such as Bluetooth or via USB cables.

To operate the portable golf ball launching device 10, an operator moves the device to a location having an impact surface of a desired quality. The operator sets the predetermined launch conditions by first rotating the ball launcher 14 and the launch monitor 24 to the predetermined launch angle β. Then the operator sets the speeds of the upper wheel and the lower wheel of the ball launcher 14 to set the launch speed and spin rate of the balls. The operator can insert balls into the ball launcher 14 through insertion tube 30. Inside the insertion tube 30 is a vacuum suction cup that holds the ball in the proper orientation and prevents the ball from inadvertently rolling into the rotating wheels. Once the operator determines that they are ready to launch the ball, a trigger simultaneously releases the vacuum holding the ball and applies air pressure to shoot the ball into the rotating wheels at an equivalent speed. The firing mechanism preferably has an adjustable air regulator connected to a pressure transducer that is part of the control system 18. The balls are ejected from the ball launcher 14 and the speed and spin rate is measured by the launch monitor 24. In an alternate embodiment, a hopper of golf balls can be coupled to the insertion tube 30 so that balls can be automatically fed into the ball launcher 14.

The laser distance finder then can be pointed at the impact location and the final roll out location of the golf balls to determine the balls' performance based on the predetermined launch conditions. The data from the launch monitor 24 and the laser distance finder are fed directly into the computer for further analysis and evaluation.

Furthermore, the frame 12 is preferably coupled to a plurality of wheels 32 so that the entire device can be readily moved from location to location, allowing the operator to easily adjust the impact location of the golf balls being ejected from the ball launcher 14. In the embodiment shown, the wheels 32 are coupled to the frame perpendicular to the launch direction of the balls for improved stability of the device. In another embodiment, the wheels can be caster wheels for further mobility of the device.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all modifications and embodiments which would come within the spirit and scope of the present invention.

We claim:

1. A portable golf ball launching device, comprising:

a frame, a ball launcher rotatably coupled to the frame for launching balls at preselected angles, speeds and spin rates, and a control system coupled to the ball launcher for varying the speed and spin rate of the balls launched from the ball launcher, wherein the ball launcher can be rotated between −20 degrees and −70 degrees from a horizontal plane.

2. The portable golf ball launching device of claim 1, wherein the ball launcher can be rotated between −30 degrees and −60 degrees from the horizontal plane.

3. The portable golf ball launching device of claim 1, wherein the ball launcher is comprised of an upper wheel and a lower wheel and the control system adjusts a first speed of the upper wheel and a second speed of the lower wheel independently.

4. The portable golf ball launching device of claim 3, wherein the ball launching speed and spin rate is adjusted by the relative speeds of the upper wheel and the lower wheel.

5. The portable golf ball launching device of claim 1 further comprising a launch monitor for measuring the speed and spin rate of the golf balls after they are launched from the ball launcher.

6. The portable golf ball launching device of claim 5, wherein the launch monitor is rotatably coupled to the frame so that the angle of the launch monitor can be adjusted.

7. The portable golf ball launching device of claim 6, wherein the launch monitor is slidably coupled to the frame such that the location of the launch monitor relative to the ball launcher can be adjusted.

8. The portable golf ball launching device of claim 1, further comprising a laser distance finder for measuring distances to an impact location of the launched golf ball and a final roll out location of the launched golf ball.

9. A portable golf ball launching device, comprising:

a frame, a ball launcher rotatably coupled to the frame for launching balls at preselected angles, speeds and spin rates;

a control system coupled to the ball launcher for varying the speed and spin rate of the balls launched from the ball launcher; and a launch monitor for measuring the speed and spin rate of the golf balls after they are launched from the ball launcher, wherein the launch monitor is rotatably coupled to the frame so that the angle of the launch monitor can be adjusted and wherein the ball launcher and the launch monitor are rotatable about a common axis.

* * * * *